US005884726A

United States Patent [19]

Chiu et al.

[11] Patent Number: 5,884,726

[45] Date of Patent: Mar. 23, 1999

[54] ADJUSTABLE DESCENDING DEVICE FOR EMERGENCY ESCAPE

[76] Inventors: Shn-Kung Chiu, 24, lane 916,Sec.2,chung Shan Rd., Tah Cha Township, Taichung Hsien, Taiwan; Ta-Ming Chiu, 3/22, Lane 916,Sec.2,Chung Shan Rd., Tah Cha Township, Taichung Hsien, Taiwan; Hung-Hui Chen, R4, Lane 32, Shng Fan Rd., Tah Cha, Taiwan

[21] Appl. No.: 815,924

[22] Filed: Mar. 13, 1997

[51] Int. Cl.[6] ..... A62B 1/20

[52] U.S. Cl. ..... 182/193; 182/5; 182/235; 184/65.2; 184/65.4

[58] Field of Search ..... 182/5, 6, 7, 72, 182/191, 192, 193, 235, 236, 240; 24/136 K, 136 L; 188/65.1, 65.2, 65.3, 65.4, 65.5

[56] References Cited

U.S. PATENT DOCUMENTS

| | | | |
|---|---|---|---|
| 1,746,759 | 2/1930 | Baker . | |
| 2,970,357 | 2/1961 | Pinson et al. | 182/193 X |
| 3,335,469 | 8/1967 | Shand et al. | 182/5 X |
| 3,889,777 | 6/1975 | George | 182/193 X |
| 3,926,278 | 12/1975 | Molnar et al. | 182/7 |
| 3,948,362 | 4/1976 | Greest | 182/5 X |
| 3,949,832 | 4/1976 | Hunter | 182/7 |
| 4,392,555 | 7/1983 | Ellis | 188/65.1 |
| 4,603,759 | 8/1986 | Hamada | 182/235 X |
| 4,714,137 | 12/1987 | Chou | 188/65.1 X |
| 5,234,075 | 8/1993 | Lowden | 182/193 X |

*Primary Examiner*—Daniel P. Stodola
*Assistant Examiner*—Richard M. Smith
*Attorney, Agent, or Firm*—Bacon & Thomas, PLLC

[57] ABSTRACT

An emergency escape device is composed of a cap, a cylindrical main body, a conical movable body, and a rope. The cap is provided with an operation pin and a plurality of movable handles capable of triggering the operation pin so as to actuate the escape device. The main body is provided therein with a conical receiving hole for disposing movably the conical movable body. The rope is wound around the conical movable body such that the rope is in contact with the inner wall of the conical receiving hole of the main body. The moving speed of the escape device is dependent on the extent of the friction between the rope and the inner wall of the conical receiving hole of the main body. The top end of the rope is fastened with a safety hook engageable with a fixed object located in a building. The main body is provided with a plurality of retainers for holding carriers intended for use in carrying escapees.

6 Claims, 3 Drawing Sheets

ADJUSTABLE DESCENDING DEVICE FOR EMERGENCY ESCAPE

FIELD OF THE INVENTION

The present invention relates generally to an emergency escape device, and more patty to a descending device designed for use as the emergency escape device in case of fire.

BACKGROUND OF THE INVENTION

The high-rise buildings are generally provided with various devices for evacuating the occupants of the high-rise buildings in case of fire. One of such devices is the descending device, which is often arranged at the comers of the buildings. The descending device comprises a rope to carry a person to safety in case of fire. The descending device is mounted at the corner of the building so as to prevent the rope of the device from being severed by the corner of the building when the device is in operation. It is very likely that the fire may break out in an area contiguous to the corner of the building to block the access to the descending device.

In addition, such a conventional emergency escape device as described above is defective in design in that the descending speed of the device can not be adjusted by a user, and that the descending motion can not be halted at will by the user.

SUMMARY OF THE INVENTION

It is therefore the primary objective of the present invention to provide an adjustable descending device for emergency escape, which is free from the shortcomings of the conventional descending device.

In keeping with the principle of the present invention, the foregoing objective of the present invention is attained by an adjustable descending device, which comprises mainly a cap, an operating main body, a rope, and a safety hook. The cap has two fixed handles and two movable handles. The cap is provided at the center thereof with a through hole in which a cruciform pin is received. The cap is further provided in the underside thereof with a recess for locating a connector between the cap and the operating main body. The operating main body of a cylindrical construction is provided therein with a conical receiving space for accommodating a movable body of a conical construction. The movable body is provided in the outer surface thereof with a winding groove in which the rope is wound around the movable body. A coil spring is located between the movable body and a bottom disk such that the upper end of the coil spring urges the movable body, and that the lower end of the coil spring is located by the bottom disk. The upper end of the rope is fastened with the safety hook which can be retained securely by a retainer fastened securely with a fixed object in the building. The operating main body is provided with a plurality of carriers to accommodate the fire escapees. The descending speed of the device can be regulated by the movable handles of the cap.

The foregoing objective, features, functions and advantages of the present invention will be more readily understood upon a thoughtful deliberation of the following detailed description of a preferred embodiment of the present invention in conjunction with the accompanying drawings.

DETAILED DESCRIPTION OF THE EMBODIMENT

Figure 1:
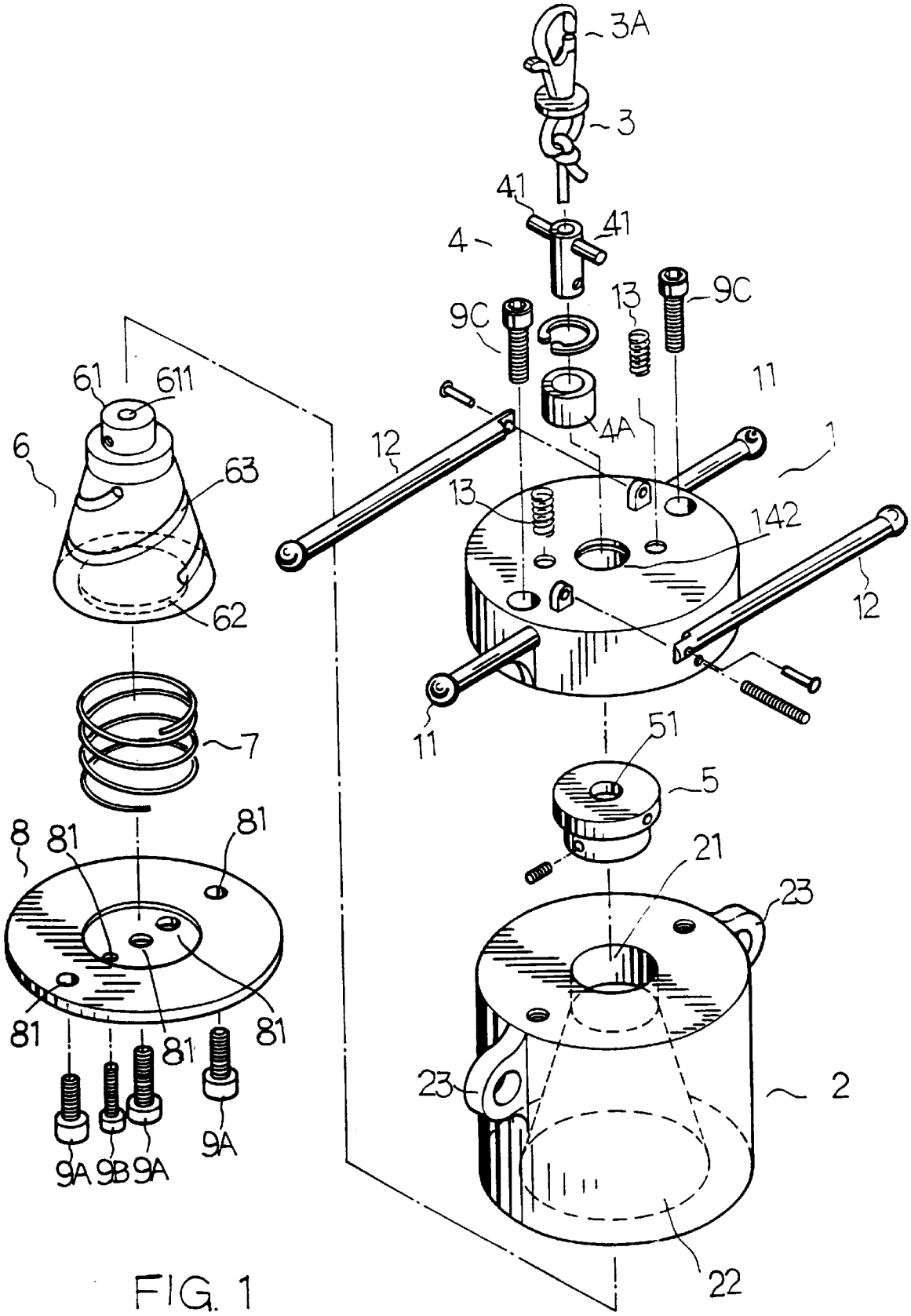
FIG. 1 shows an exploded view of the preferred embodiment of the present invention.
Figure 2:
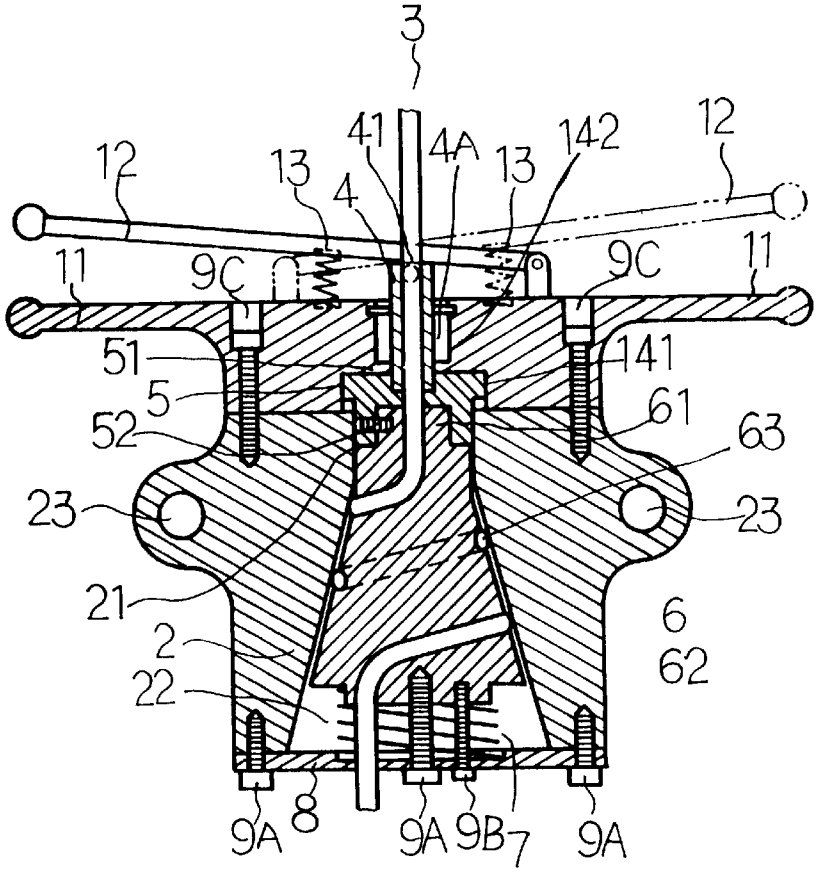
FIG. 2 shows a perspective view of the preferred embodiment in combination according to the present invention.
Figure 3:
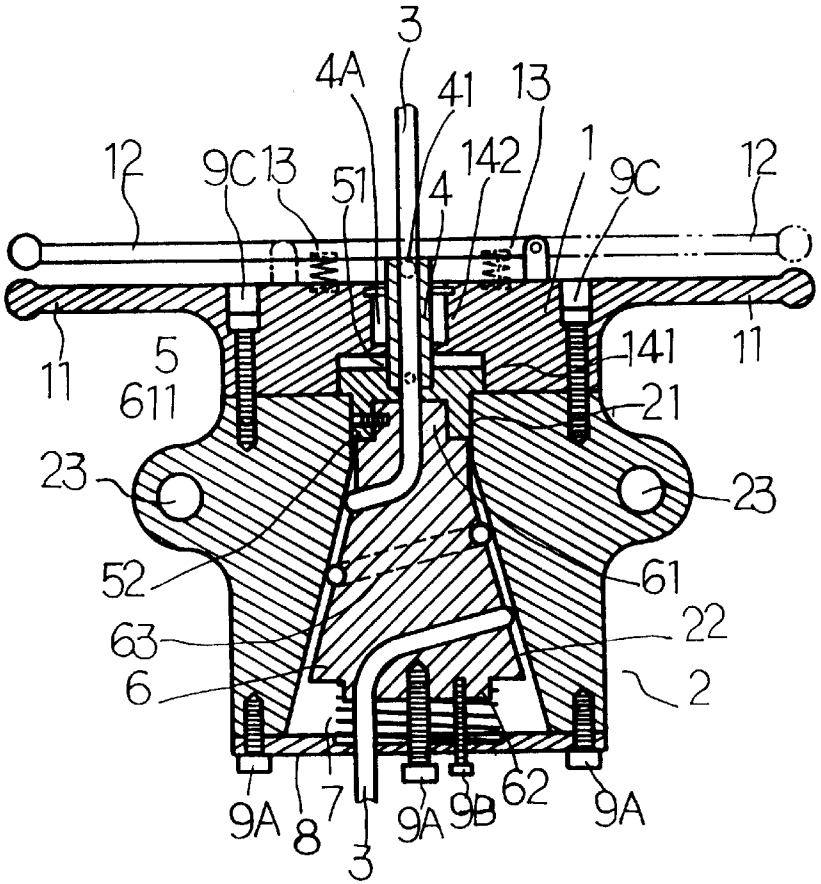
FIG. 3 shows a schematic view of the present invention at work.
Figure 4:
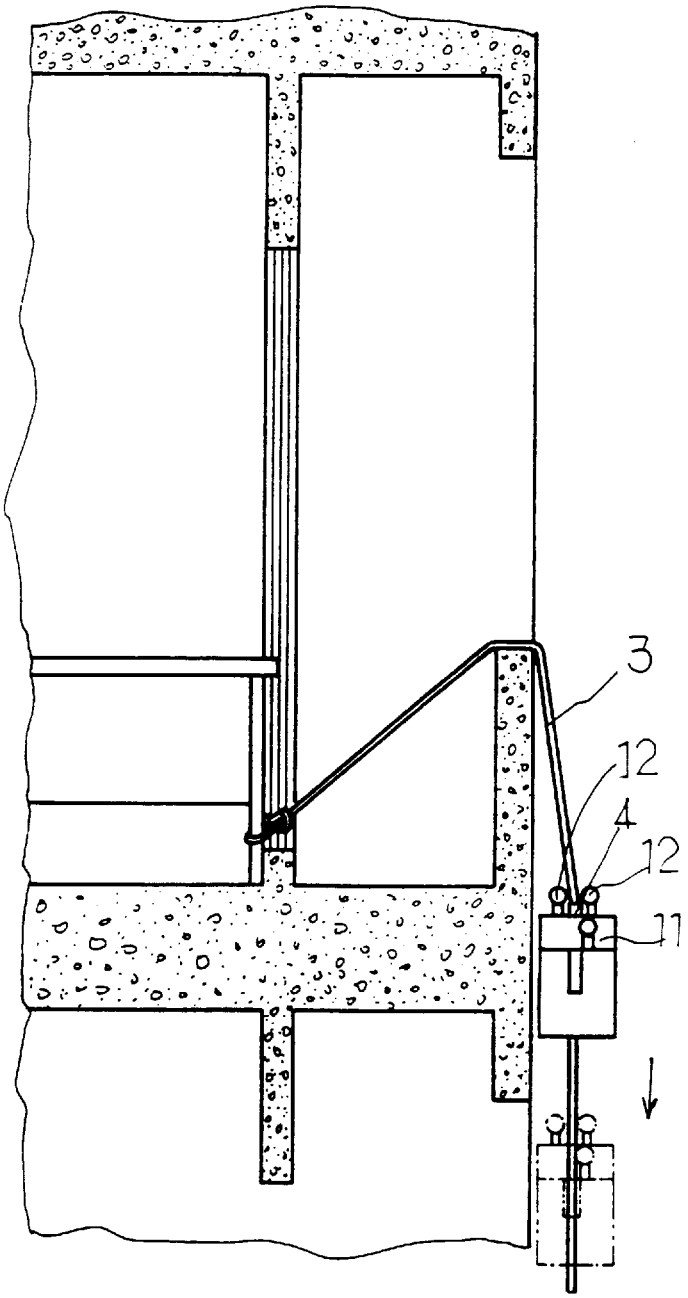
FIG. 4 shows another schematic view of the present invention in use.

As illustrated in all drawings provided herewith, an emergency escape device embodied in the present invention is composed of the component parts, which are described explicitly hereinafter.

A cap 1 of a disklike construction is provided with two fixed handles 11 and two movable handles 12 for operating the device. The movable handles 12 are provided respectively with a spring 13. The cap 1 is provided at the center of the upper side thereof with a circular receiving hole 142 and at the center of the underside thereof with a circular slot 141 in communication with the receiving hole 142. The receiving hole 142 is intended to locate a cruciform pin 4 in conjunction with a bearing 4A while the slot 141 is dimensioned to locate a connector 5 having an upper receiving hole 51 and a lower receiving hole 52 greater in diameter than the upper receiving hole 51 and in communication with the upper receiving hole 51. The connector 5 has a head of a disklike construction and a short cylindrical body extending from the underside of the head. The cruciform pin 4 has two arms 41 opposite to each other. The circular slot 141 and the circular receiving hole 142 are different in diameter.

An operating main body 2 is of a cylindrical construction and is provided at the center of the upper end thereof with a receiving hole 21 for locating the connector 5 between the cap 1 and the operating main body 2. The operating main body 2 is further provided in the underside thereof with a conical receiving hole 22 extending into the interior of the main body 2 such that the conical receiving hole 22 is in communication with the receiving hole 21. The main body 2 is further provided in the periphery therof with a plurality of retainers 23 for retaining the carriers (not shown in the drawings) intended for use in carrying the fire escapees.

A conical movable body 6 is movably arranged in the conical receiving hole 22 of the main body 2. The conical movable body 6 is provided on the apex thereof with a circular projection 61 having a through hole 611 and is further provided in the outer surface thereof with a winding groove 63 which has an upper end in communication with the through hole 611 of the circular projection 61. The conical movable body 6 is still further provided in the underside of the bottom end thereof with a ring protuberance 62.

A rope 3 is fastened at the top end thereof with a safety hook 3A engageable securely with a fixed object located in the building. The rope 3 is received in the axial hole of the cruciform pin 4, the receiving hole 142 of the cap 1, the receiving holes 51 and 52 of the connector 5 such that the rope 3 is wound along the winding groove 63 of the conical movable body 6 via the through hole 611 of the circular projection 61 of the movable body 6.

A bottom disk 8 is provided with a plurality of fastening holes 81 for fastening the bottom disk 8 with the underside of the main body 2 in conjunction with a plurality of fastening bolts 9A engageable with the fastening holes 81. Located between the bottom disk 8 and the conical movable body 6 is a coil spring 7, which urges the ring protuberance 62 of the conical movable body 6. In addition, the bottom disk 8 is provided with a restriction bolt 9B which is engaged with one of the fastening holes 81 for preventing the movable body 6 from being actuated to rotate.

In case of emergency, the device of the present invention is used for escape. The safety hook 3A is first engaged with the fixed object located in the building such that other end of the rope is allowed to reach the ground before an escapee is seated securely in the carrier which is fastened with the main body 2. As the movable handle 12 is pushed upwards by the escapee such that the arms 41 of the cruciform pin 4 is forced to move downwards, and that the conical movable body 6 is subsequently actuated by the connector 5 to move downwards. As a result, the rope 3 wound around the winding groove 63 of the conical movable body 6 is no longer in contact with the inner wall of the conical receiving hole 22 of the main body 2, thereby allowing the device of the present invention to move along the rope 3 towards the ground. The descending speed is dependent on the magnitude of the pressure exerting on the cruciform pin 4. In other words, the extent of friction between the rope 3 and the inner wall of the conical receiving hole 22 of the main body 2 is dependent on the magnitude of the pressure exerting on the arms 41 of the cruciform pin 4. As the movable handle 12 is released by the escapee, the conical movable body 6 is pushed back to its original position in the conical receiving hole 22 by the elastic force of the coil spring 7. As a result, the device of the present invention in motion comes to a halt immediately.

The embodiment described above is to be regarded in all respects as being merely illustrative and not restrictive. Accordingly, the present invention may be embodied in other specific forms without deviating from the spirit thereof. The present invention is therefore to be limited only by the scope of the hereinafter appended claim.

What is claimed is:

1. An emergency escape device comprising:

a cap provided with at least one fixed handle and one movable handle, said cap further provided with a through hole for locating a hollow pin and a connector having an upper receiving hole and a lower receiving hole in communication with said upper receiving hole;

a cylindrical main body provided in one end thereof with a receiving hole for locating said connector, said main body further provided in another end thereof with a conical receiving hole extending into an interior of said main body such that said conical receiving hole is in communication with said receiving hole of said one end of said main body, said main body further provided in a periphery thereof with at least one retainer for holding a carrier intended for use in carrying a person;

a conical movable body disposed movably in said conical receiving hole of said main body and provided on an apex thereof with a projection having a through hole, said conical movable body further provided in an outer surface thereof with a winding groove having one end in communication with said through hole of said projection of said apex of said conical movable body, said conical movable body still further provided with a ring protuberance located in an underside of a bottom end thereof;

a rope fastened at one end thereof with a retainer engageable securely with a fixed object located in a building, said rope having another end which is put through an axial hole of said hollow pin, said through hole of said cap, said upper receiving hole and said lower receiving hole of said connector such that said rope is wound along said winding groove of said conical movable body via said through hole of said projection of said conical movable body;

a base provided with a plurality of fastening holes for fastening said base with said main body in conjunction with a plurality of fastening bolts engageable with said fastening holes;

and a biasing means located between said base and said conical movable body such that one end of said biasing means urges said conical movable body.

2. The emergency escape device as defined in claim 1, wherein said hollow pin is of a cruciform construction and provided with two arms opposite to each other and capable of being forced by said movable handle to displace and trigger said connector to actuate said conical movable body to move such that said rope wound along said winding groove of said conical movable body is not in contact with an inner wall of said conical receiving hole of said main body.

3. The emergency escape device as defined in claim 1, wherein said through hole of said cap is formed of an upper through hole and a lower through hole different in diameter from said upper through hole.

4. The emergency escape device as defined in claim 1, wherein said upper receiving hole of said connector is different in diameter from said lower receiving hole of said connector.

5. The emergency escape device as defined in claim 1, wherein said connector has a head and a cylindrical body extending from said head; and wherein said receiving hole of said main body is engaged with said cylindrical body of said connector.

6. The emergency escape device as defined in claim 1, wherein said biasing means is a coil spring having one end which urges said ring protuberance of said conical movable body.

* * * * *